US009142163B2

(12) United States Patent
Jin et al.

(10) Patent No.: US 9,142,163 B2
(45) Date of Patent: Sep. 22, 2015

(54) ORGANIC LIGHT EMITTING DISPLAY DEVICE

(75) Inventors: Guang-Hai Jin, Yongin (KR); Jae-Beom Choi, Yongin (KR); Kwan-Wook Jung, Yongin (KR); June-Woo Lee, Yongin (KR); Moo-Jin Kim, Yongin (KR); Ga-Young Kim, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 139 days.

(21) Appl. No.: 13/528,294

(22) Filed: Jun. 20, 2012

(65) Prior Publication Data

US 2013/0155033 A1 Jun. 20, 2013

(30) Foreign Application Priority Data

Dec. 19, 2011 (KR) ..... 10-2011-0137421

(51) Int. Cl.
*G09G 3/32* (2006.01)

(52) U.S. Cl.
CPC ..... *G09G 3/3266* (2013.01); *G09G 2330/12* (2013.01)

(58) Field of Classification Search
USPC ..... 345/76–83, 204
See application file for complete search history.

(56) References Cited

U.S. PATENT DOCUMENTS

| | | | | |
|---|---|---|---|---|
| 7,649,513 | B2 * | 1/2010 | Park et al. | 345/76 |
| 2005/0007319 | A1 * | 1/2005 | Shin et al. | 345/76 |
| 2007/0139312 | A1 | 6/2007 | Kwak | |
| 2008/0068357 | A1 * | 3/2008 | Hu | 345/204 |
| 2008/0150846 | A1 * | 6/2008 | Chung | 345/80 |
| 2010/0141646 | A1 * | 6/2010 | Tanabe | 345/214 |
| 2010/0237895 | A1 | 9/2010 | Chung | |
| 2011/0090200 | A1 * | 4/2011 | Choi et al. | 345/211 |

FOREIGN PATENT DOCUMENTS

| | | | |
|---|---|---|---|
| KR | 1020060103590 | A | 10/2006 |
| KR | 1020070114792 | A | 5/2009 |

* cited by examiner

*Primary Examiner* — Kenneth Bukowski
(74) *Attorney, Agent, or Firm* — Robert E. Bushnell, Esq.

(57) ABSTRACT

An organic light emitting display device includes a pixel unit including a plurality of pixels formed in regions where a plurality of scan lines and a plurality of data lines cross each other, a first scan driving unit detecting a defect of the plurality of pixels by sequentially applying a first test signal to the plurality of scan lines, and a second scan driving unit detecting a defect of the plurality of pixels by simultaneously applying a second test signal to the plurality of scan lines.

14 Claims, 10 Drawing Sheets

ORGANIC LIGHT EMITTING DISPLAY DEVICE

CLAIM OF PRIORITY

This application makes reference to, incorporates the same herein, and claims all benefits accruing under 35 U.S.C. §119 from an application earlier filed in the Korean Intellectual Property Office on the 19 Dec. 2011 and there duly assigned Serial No. 10-2011-0137421.

BACKGROUND OF THE INVENTION

1. Field of the Invention

The present invention relates to an organic light emitting display device.

2. Description of the Related Art

Recently, various types of flat panel display apparatuses having decreased weight and volume, which are disadvantage of cathode ray tubes (CRTs), are being developed. Examples of the flat panel display apparatuses include a liquid crystal display (LCD), a field emission display (FED), a plasma display panel (PDP), an organic light emitting display device, and the like.

The organic light emitting display device from among the flat panel display apparatuses displays an image by using an organic light emitting diode (OLED) that generates light due to recombination of electrons and holes, and is advantageous in fast response speed and low power consumption.

The organic light emitting display device has a panel having pixels formed therein, and driving circuits for driving the panel, wherein, in the pixels, a plurality of scan lines and a plurality of data lines are arrayed to cross each other, and thin film transistors (TFTs) are formed in regions defined in a manner that the scan lines and the data lines vertically cross each other.

After the manufacturing of the organic light emitting display device is completed, a subsequent process is performed to test the panel and the driving circuits.

SUMMARY OF THE INVENTION

The present invention provides a simultaneous emission-type organic light emitting display device including a panel and driving circuits that can be tested and normally driven.

According to an aspect of the present invention, there is provided an organic light emitting display device including a pixel unit including a plurality of pixels formed in regions where a plurality of scan lines and a plurality of data lines cross each other, a first scan driving unit detecting a defect of the plurality of pixels by sequentially applying a first test signal to the plurality of scan lines, and a second scan driving unit detecting a defect of the plurality of pixels by simultaneously applying a second test signal to the plurality of scan lines.

The first scan driving unit may have a plurality of stages, and each of the plurality of stages may include a shift register.

The second scan driving unit may include a first control line outputting a first control signal, a second control line outputting a second control signal, and a plurality of switching devices each having a structure in which a gate is electrically connected to the first control line, a first electrode is electrically connected to the second control line, and a second electrode is electrically connected to a corresponding scan line from among the plurality of scan lines.

Each of the plurality of switching devices may be turned on by the first control signal and then may output the second control signal, as the second test signal, to the corresponding scan line from among the plurality of scan lines.

The plurality of switching devices may correspond to the plurality of scan lines, respectively, and may be connected in parallel along the first control line and the second control line.

The second scan driving unit may further include pads that apply the first control signal and the second control signal.

The first scan driving unit may detect a defect of the plurality of stages according to whether the first test signal is output to the plurality of scan lines.

In a normal mode, the first scan driving unit may sequentially apply a scan signal to the plurality of scan lines during a section of one frame period, and the second scan driving unit may simultaneously apply a scan signal to the plurality of scan lines during other sections of the one frame period.

In a normal mode, the first scan driving unit may sequentially apply a scan signal to the plurality of scan lines during a section of one frame period while the pixel unit emits light.

The organic light emitting display device may further include a data driving unit applying a data signal to a pixel via a corresponding data line from among the plurality of data lines, wherein the pixel is turned on by the first test signal or the second test signal; and a timing unit controlling the first scan driving unit, the second scan driving unit, and the data driving unit.

According to another aspect of the present invention, there is provided an organic light emitting display device driven in a normal mode and a test mode, and including a pixel unit including a plurality of pixels formed in regions where a plurality of scan lines and a plurality of data lines cross each other, a first scan driving unit detecting a defect of the plurality of pixels by sequentially applying a first test signal to the plurality of scan lines in the test mode, and sequentially applying a scan signal to the plurality of scan lines so that a data signal is applied to a pixel via a corresponding data line from among the plurality of data lines in the normal mode, wherein the pixel is turned on by the scan signal, and a second scan driving unit detecting a defect of the plurality of pixels by simultaneously applying a second test signal to the plurality of scan lines in the test mode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
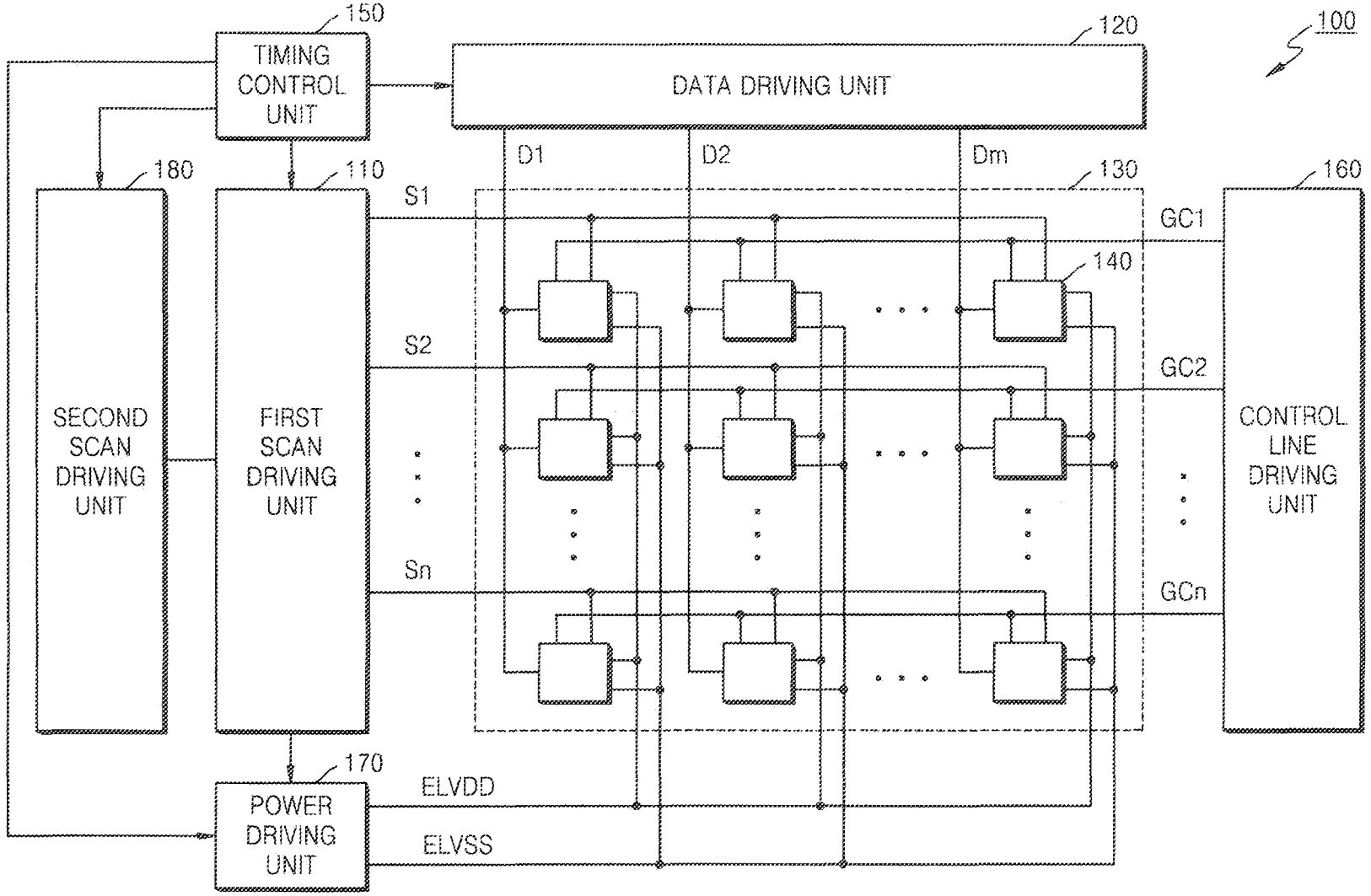
FIG. 1 is a block diagram of an organic light emitting display device according to an embodiment of the present invention.

Hereinafter, the present invention will be described in detail by explaining exemplary embodiments of the invention with reference to the attached drawings. Like reference numerals in the drawings denote like elements. In the description of the present invention, certain detailed explanations of related art are omitted when it is deemed that they may unnecessarily obscure the essence of the invention.

While terms "first" and "second" are used to describe various components, it is obvious that the components are not limited to the terms "first" and "second". The terms "first" and "second" are used only to distinguish between each component. For example, a first component may indicate a second component or a second component may indicate a first component without conflicting with the present invention.

As used herein, the term "and/or" includes any and all combinations of one or more of the associated listed items.

Expressions such as "at least one of," when preceding a list of elements, modify the entire list of elements and do not modify the individual elements of the list.

FIG. 1 is a block diagram of an organic light emitting display device 100 according to an embodiment of the present invention.

Referring to FIG. 1, the organic light emitting display device 100 includes a pixel unit 130, a first scan driving unit 110, a second scan driving unit 180, a data driving unit 120, a timing control unit 150, a control line driving unit 160, and a power driving unit 170.

The pixel unit 130 includes pixels 140 that are connected with scan lines S1 through Sn, control lines GC1 through GCn, data lines D1 through Dm, and first and second power lines ELVDD and ELVSS. The pixels 140 included in the pixel unit 130 are formed at cross points between the scan lines S1 through Sn and the data lines D1 through Dm. The pixels 140 control current that is supplied from the first power line ELVDD to the second power line ELVSS via an organic light emitting diode (OLED), in response to a data signal. Then, light having a predetermined brightness is generated in the OLED.

The organic light emitting display device 100 is a display device that is driven based on a simultaneous emission method, and may operate in a test mode for examining a defect of the pixel unit 130 and in a scan mode for displaying an image according to normal driving of the pixel unit 130.

The first scan driving unit 110 and the second scan driving unit 180 provide a scan signal or a test signal to each of the pixels 140 via the scan lines S1 through Sn. In the test mode, the first scan driving unit 110 sequentially applies a test signal for examining the defect of the pixel unit 130 to the scan lines S1 through Sn, and in the scan mode, the first scan driving unit 110 sequentially applies a scan signal of normal driving of the pixel unit 130 to the scan lines S1 through Sn. That is, the first scan driving unit 110 allows a data signal to be sequentially input to the pixels 140 by sequentially inputting the test signal or the scan signal to the scan lines S1 through Sn. In the test mode, the second scan driving unit 180 may simultaneously apply a test signal for examining the defect of the pixel unit 130 to all of the scan lines S1 through Sn, and in the scan mode, the second scan driving unit 180 may simultaneously apply a scan signal of normal driving of the pixel unit 130 to all of the scan lines S1 through Sn. That is, the second scan driving unit 180 may simultaneously input the test signal or the scan signal to all of the scan lines S1 through Sn.

The control line driving unit 160 provides a control signal to each of the pixels 140 via the control lines GC1 through GCn.

The data driving unit 120 provides a data signal to each of the pixels 140 via the data lines D1 through Dm.

The timing control unit 150 controls the first scan driving unit 110, the second scan driving unit 180, the data driving unit 120, and the control line driving unit 160. However, the second scan driving unit 180 may be separately controlled by an external signal in the test mode.

The power driving unit 170 provides a first power ELVDD (t) to each of the pixels 140 via the first power line ELVDD, and provides a second power ELVSS(t) to each of the pixels 140 via the second power line ELVSS. In the present embodiment, at least one of the first power ELVDD(t) and the second power ELVSS(t) is applied to each of the pixels 140 of the pixel unit 130 by a voltage having different levels during one frame period.

The power driving unit 170 may receive control signals to drive the first power ELVDD(t) and the second power ELVSS (t), and in this regard, the control signals that are input to the power driving unit 170 may be generated in the timing control unit 150 or the first scan driving unit 110 and then may be input to the power driving unit 170.

Figure 2:
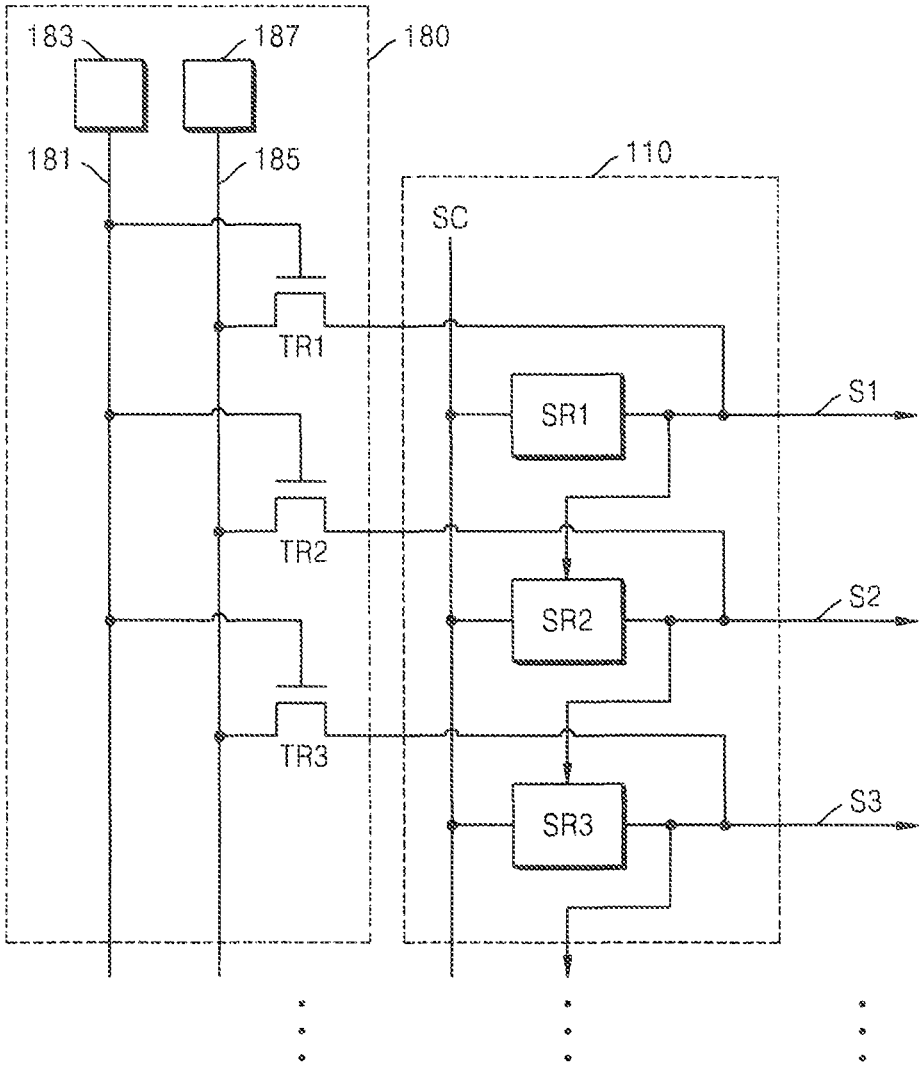
FIG. 2 is a block diagram illustrating a configuration of a scan driving unit, according to an embodiment of the present invention.

FIG. 2 is a block diagram illustrating a configuration of a scan driving unit, according to an embodiment of the present invention.

Referring to FIG. 2, the scan driving unit may include the first scan driving unit 110 and the second scan driving unit 180.

The first scan driving unit 110 includes a plurality of stages that sequentially output a test signal or a scan signal to each of scan lines S1 through Sn, and each of the stages includes shift register blocks SR. For convenience of description, FIG. 2 illustrates only first shift register block SR1 of a first stage through third shift register block SR3 of a third stage.

In a normal mode, each shift register block SR is connected to a signal line SC, receives a clock signal and/or a control signal from the signal line SC, outputs a scan signal to a corresponding scan line, and simultaneously supplies the scan signal to a shift register block SR of a next stage, as a start signal for the shift register block SR of the next stage. A scan start signal SSP is input to the first shift register block SR1, and an output signal from a previous shift register block, i.e., the scan signal is input to second through $n_{th}$ shift register blocks SR2 through SRn.

In a test mode, each shift register block SR is connected to the signal line SC, receives a clock signal and/or a control signal from the signal line SC, outputs a test signal to a corresponding scan line, and simultaneously supplies the test signal to the shift register block SR of the next stage, as a start signal for the shift register block SR of the next stage. A scan start signal SSP is input to the first shift register block SR1, and an output signal from the previous shift register block, i.e., the test signal is input to the second through $n_{th}$ shift register blocks SR2 through SRn. The test signal has the same level as the scan signal.

For convenience of description, the signal line SC is a single line in FIG. 2, however, the signal line SC may include one or more clock signal supply lines and control signal supply lines.

The second scan driving unit 180 includes a plurality of switching devices TR for simultaneously outputting a test signal or a scan signal to the scan lines S1 through Sn, and a first control line 181 and a second control line 185 that apply a control signal to the switching devices TR. The first control line 181 and the second control line 185 are connected to a first pad 183 and a second pad 187, respectively, which supply the control signal. For convenience of description, FIG. 2 illustrates only first through third switching devices TR1 through TR3.

The switching devices TR are disposed in parallel while the switching devices TR correspond to the scan lines S1 through Sn, respectively, in a direction along the first control line 181 and the second control line 185. In each of the switching devices TR, a gate is electrically connected to the first control line 181, a first electrode is electrically connected to the second control line 185, and a second electrode is electrically connected to a corresponding scan line from among the scan lines S1 through Sn.

In the normal mode, each of the switching devices TR is turned on by a first control signal applied to the first control line 181, and the switching devices TR simultaneously apply a second control signal, as a scan signal, to the scan lines S1 through Sn, respectively, wherein the second control signal is applied to the second control line 185.

In the test mode, each of the switching devices TR is turned on by the first control signal applied to the first control line 181, and the switching devices TR simultaneously apply the second control signal, as a test signal, to the scan lines S1 through Sn, respectively, wherein the second control signal is applied to the second control line 185.

In a case where each switching device TR is formed as an n-channel metal-oxide-semiconductor field-effect transistor (NMOS transistor), as in the present embodiment, each switching device TR is turned on by a first control signal having a high level, and in a case where each switching device TR is formed as a PMOS transistor, each switching device TR is turned on by a first control signal having a low level. The second control signal corresponds to a scan signal having a high level or a low level, which turns on each of the switching devices TR that configure the pixels 140 and are connected to the scan lines S1 through Sn.

Figure 3A:
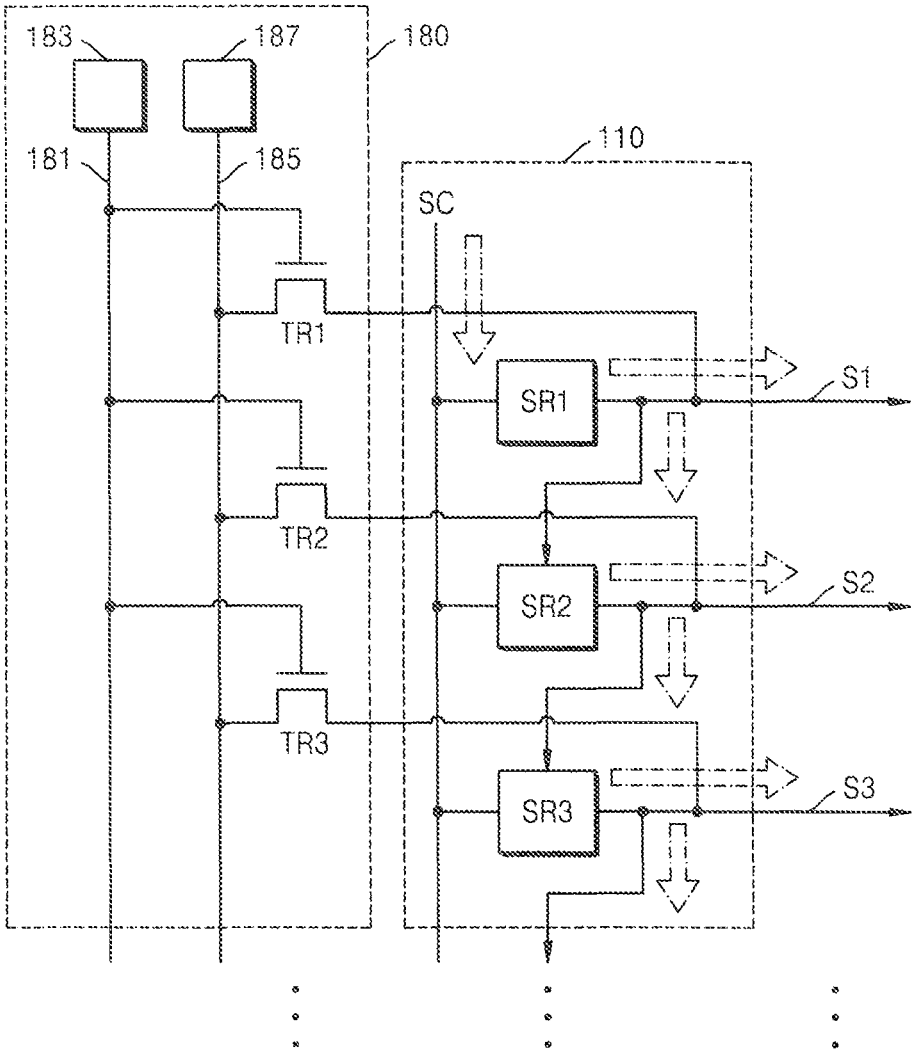
FIGS. 3A, 3B and 4 illustrate a method of testing an organic light emitting display device, according to an embodiment of the present invention.
Figure 3B:
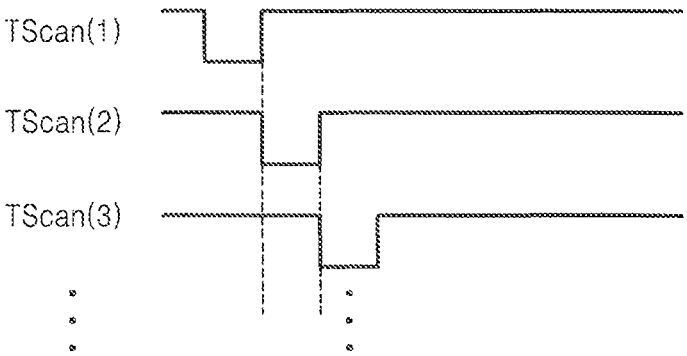
Figure 4:
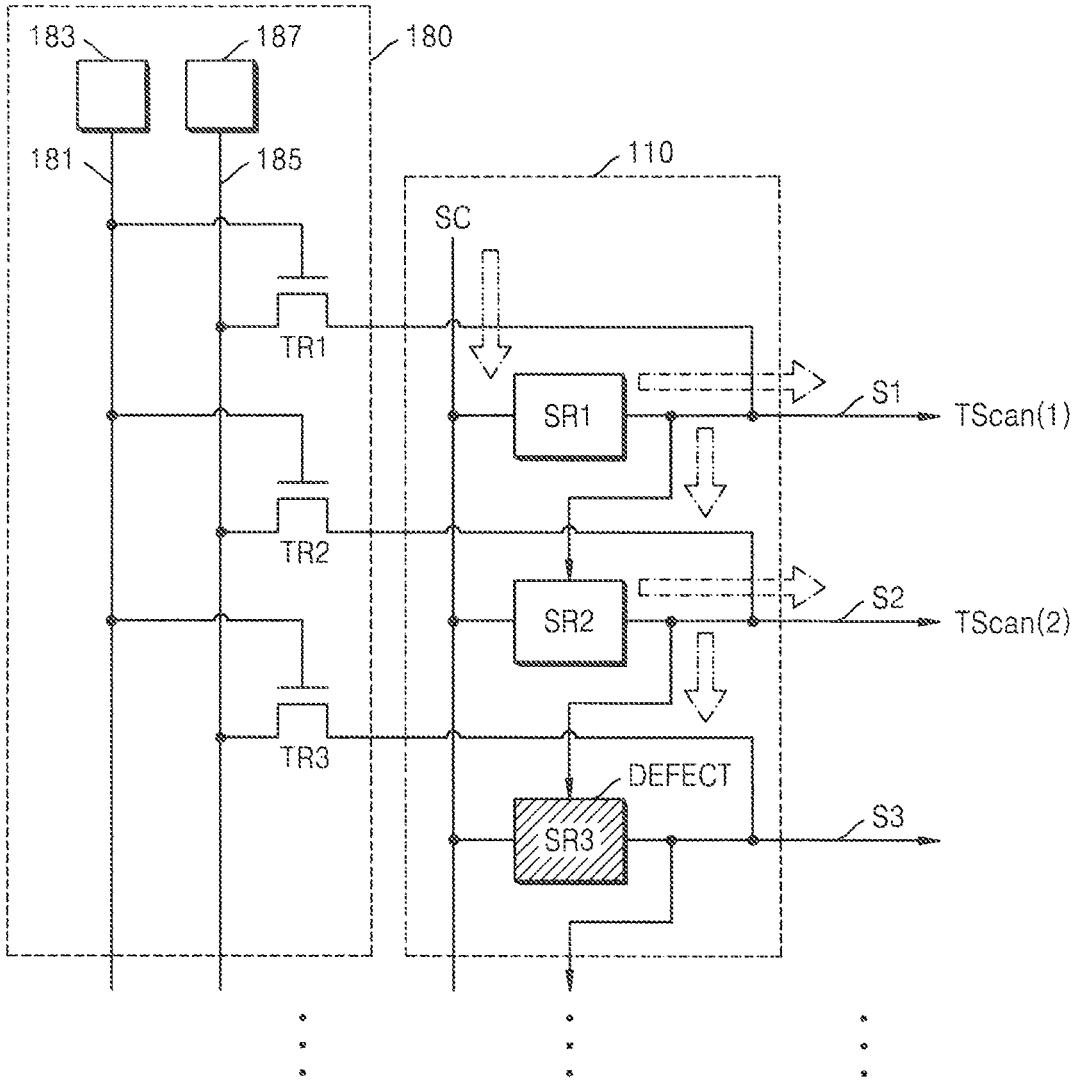
Figure 5:
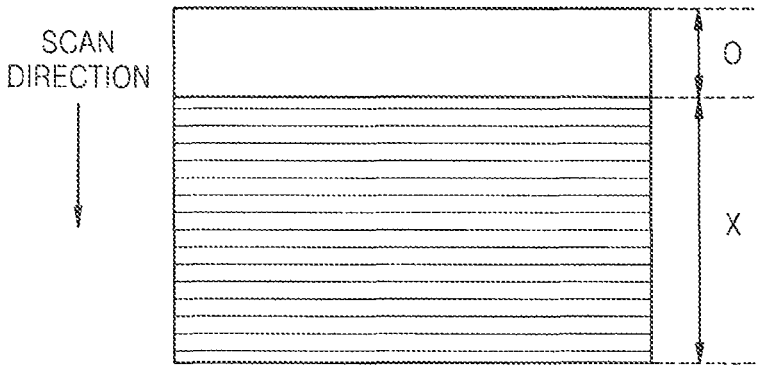
FIG. 5 illustrates an example of an image displayed on a pixel unit when a defect occurs in a shift register block.

FIGS. 3A, 3B and 4 illustrate a method of testing an organic light emitting display device, according to an embodiment of the present invention. FIG. 5 illustrates an example of an image displayed on a pixel unit when a defect occurs in a shift register block.

Referring to FIG. 3A, a clock signal and a control signal are applied to a signal line SC of the first scan driving unit 110.

Accordingly, a first shift register block SR1 receives an initial scan start signal, the clock signal, and the control signal and then outputs a first test signal TScan(1) to a first scan line S1. Afterward, a second shift register block SR2 receives the first test signal TScan(1), the clock signal, and the control signal, and then outputs a second test signal TScan(2) to a second scan line S2. Afterward, a third shift register block SR3 receives the second test signal TScan(2), the clock signal, and the control signal, and then outputs a third test signal TScan(3) to a third scan line S3. Similarly, fourth shift register block SR4 through $n_{th}$ shift register block SRn receive the third test signal TScan(3) through a $(n-1)_{th}$ test signal TScan (n−1) of previous stages, the clock signal, and the control signal, and then output test signals TScan(4) through TScan (n) to scan lines S4 through Sn, respectively.

As illustrated in FIG. 3B, the test signals TScan(1) through TScan(n) are sequentially applied to the scan lines S1 through Sn, and thus the pixels 140 that are connected to the scan lines S1 through Sn, respectively, are turned on, a data signal is applied to each of the pixels 140, and then each of the pixels 140 emits light. Here, if there is any pixel 140 that does not emit light, that pixel 140 is defective.

In a case where a defect occurs in an arbitrary shift register block, for example, as illustrated in FIG. 4, if the third shift register block SR3 is inactive due to a defect, the third shift register block SR3 does not output the third test signal TScan (3), thus, the fourth shift register block SR4 through the $n_{th}$ shift register block SRn that are positioned in next stages do not output test signals. Thus, a shift register block that does not output a test signal to a scan line may be determined as a defective one. That is, the first scan driving unit 110 may detect a defective, shift register block.

In this case, as illustrated in FIG. 5, the pixels 140 that are connected to the first and second scan lines S1 and S2 having received the first and second test signals TScan(1) and TScan (2) normally emit light (O), and the pixels 140 that are connected to the third through $n_{th}$ scan lines S3 through Sn do not emit light (X). Thus, in the test mode by the first scan driving unit 110, it is difficult to detect a defective pixel of the pixel unit 130.

FIG. 6 illustrates a method of testing an organic light emitting display device, according to another embodiment of the present invention.

Figure 6A:
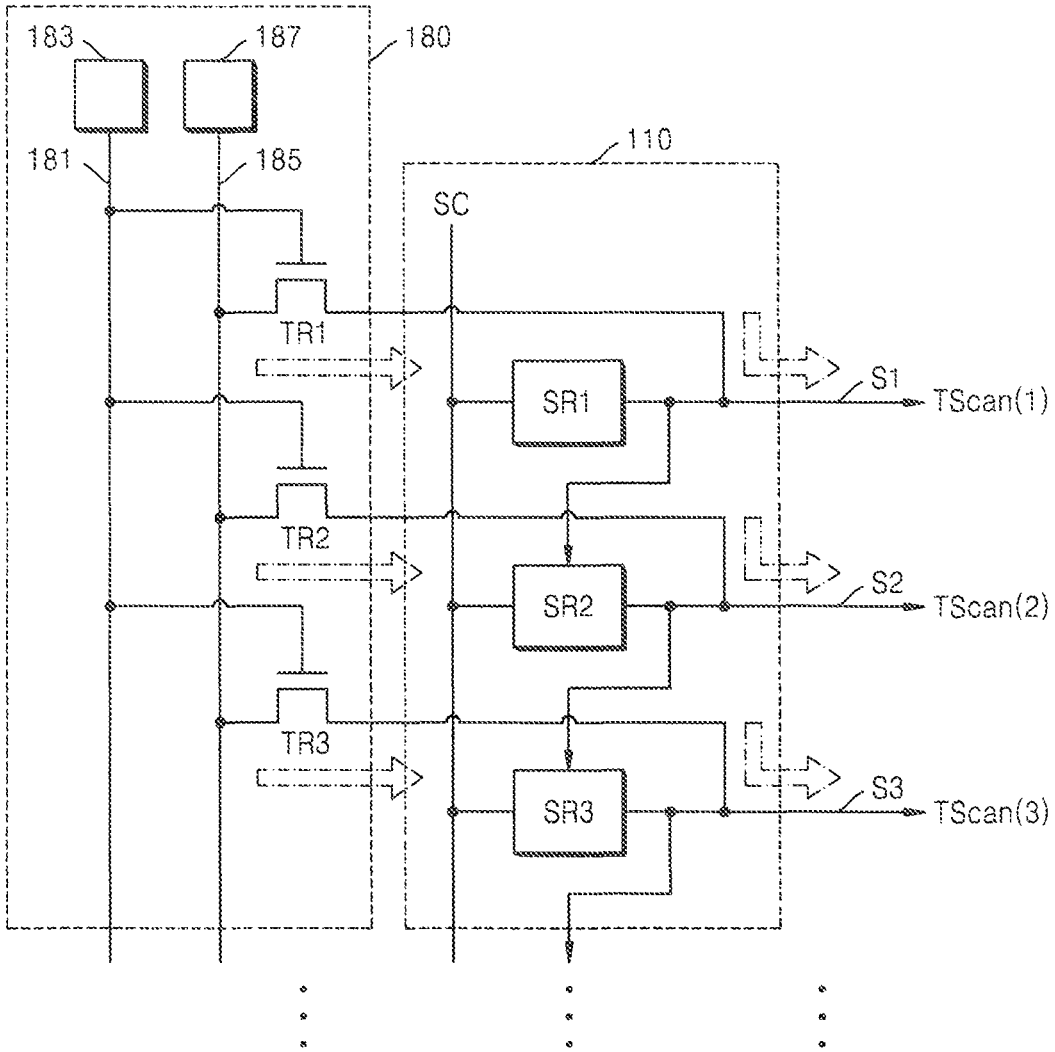
FIGS. 6A and 6B illustrate a method of testing an organic light emitting display device, according to another embodiment of the present invention.

Referring to FIG. 6A, a first control signal is applied to the first control line 181 of the second scan driving unit 180, and a second control signal is applied to the second control line 185.

Accordingly, switching devices TR that are connected in parallel are all turned on by the first control signal, and the second control signal, as test signals TScan(1) through TScan (n), is simultaneously applied to the scan lines S1 through Sn via the switching devices TR, respectively.

Figure 6B:
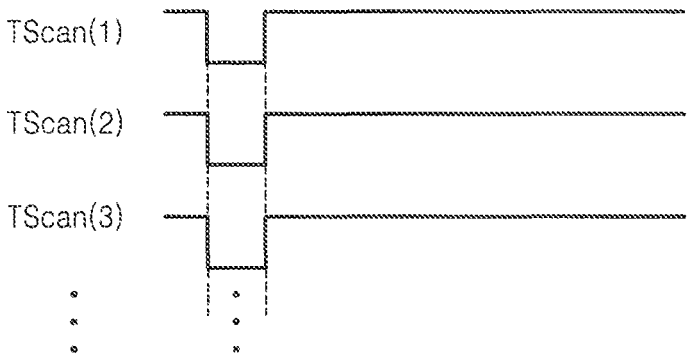

As illustrated in FIG. 6B, the test signals TScan(1) through TScan(n) are simultaneously applied to the scan lines S1 through Sn, and thus the pixels 140 that are connected to the scan lines S1 through Sn, respectively, are turned on, a data signal is applied to each of the pixels 140, and then each of the pixels 140 emits light. Accordingly, all of the pixels 140 simultaneously emit light, so that a pixel that does not emit light may be determined as a defective pixel.

In the test mode by the second scan driving unit 180, it is possible to detect a defective pixel although a defect occurs in an arbitrary shift register block in the first scan driving unit 110. Also, since the second scan driving unit 180 has a simple circuit structure, a test signal output therefrom has a high signal to noise ratio (SNR), compared to a signal from a shift register block, so that a detection ratio is increased. Also, in a case where an arbitrary switching device is defective in the second scan driving unit 180, a test signal is not applied to a corresponding scan line but is normally applied to the rest of scan lines, so that a ratio of defective pixel detection is increased.

Figure 7:
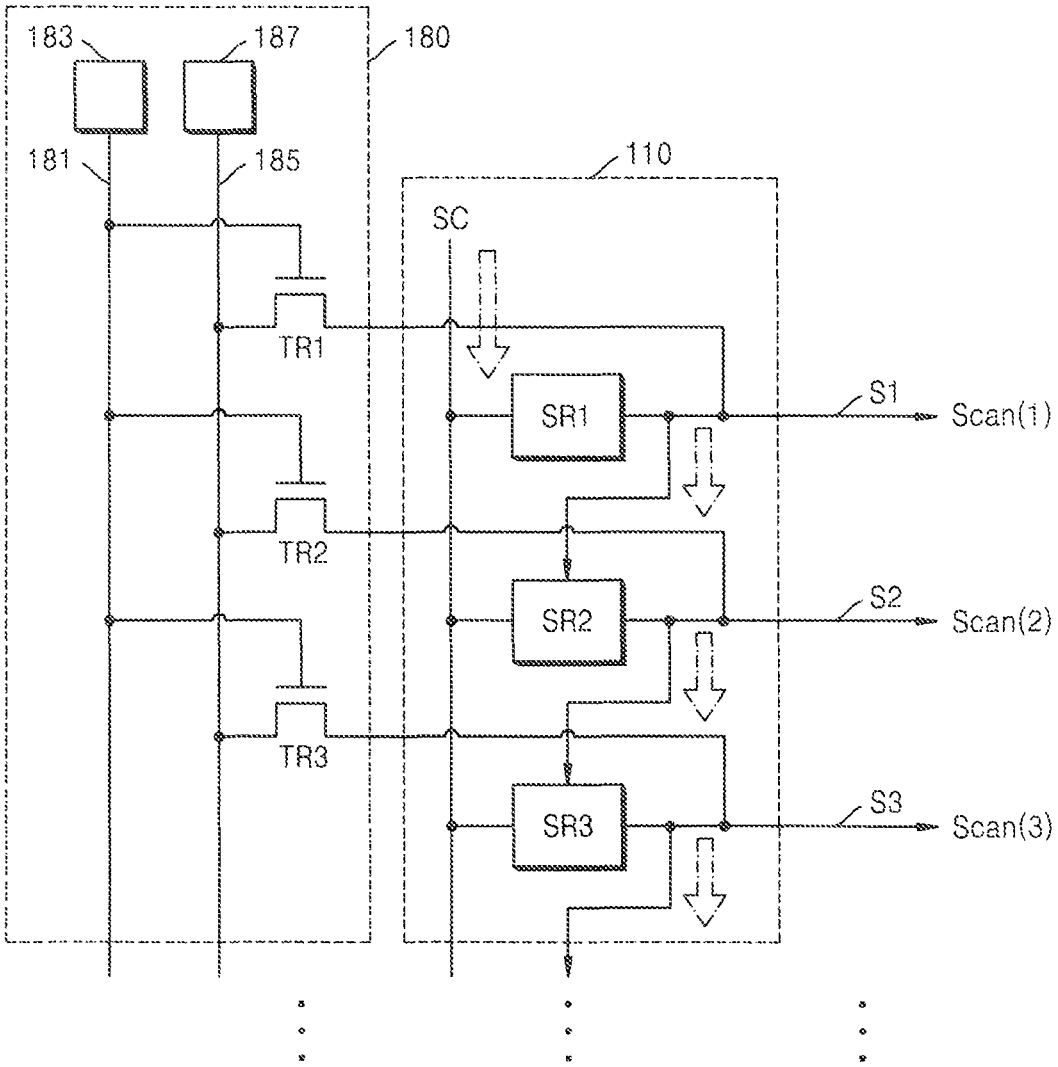
FIGS. 7 through 9 illustrate a method of driving an organic light emitting display device, according to an embodiment of the present invention.
Figure 8:
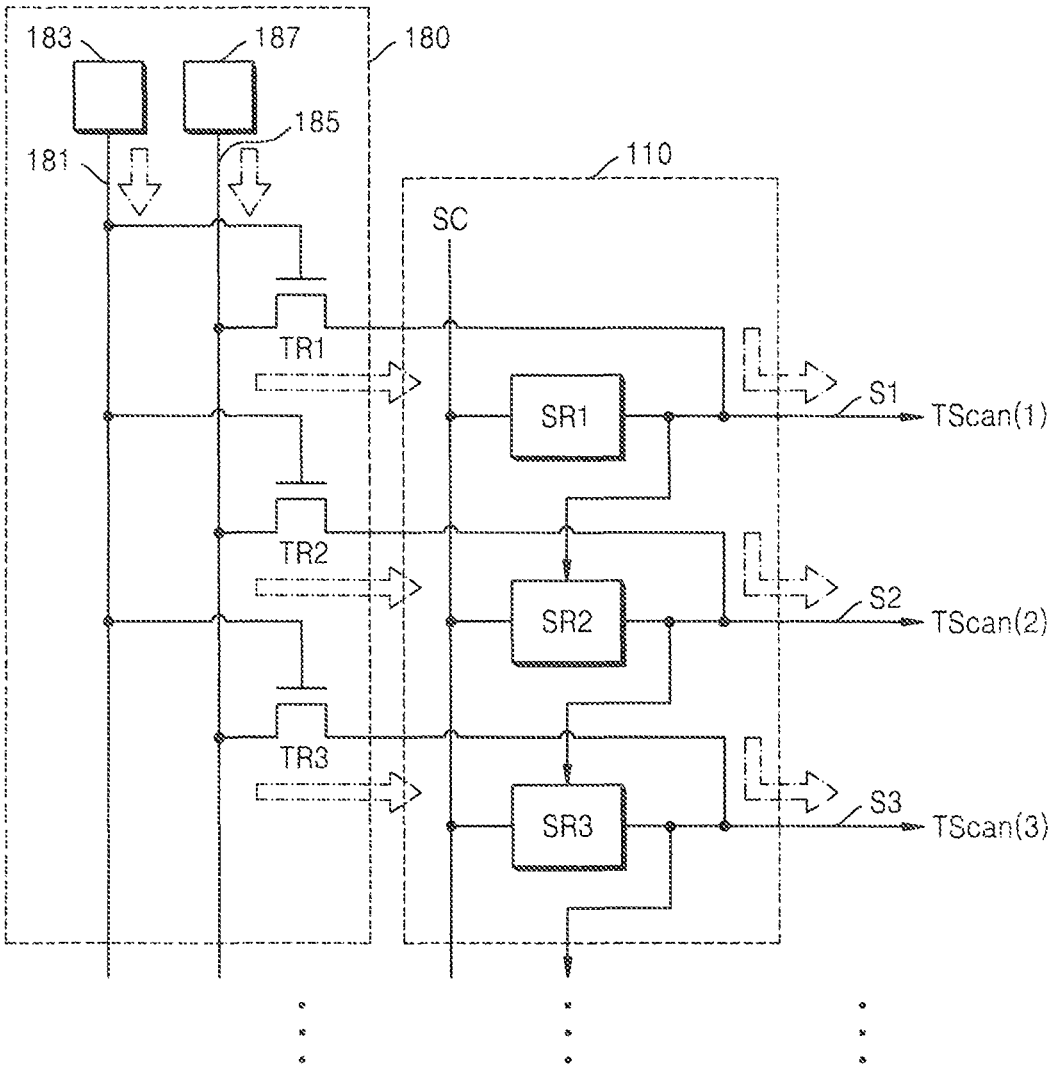
Figure 9:
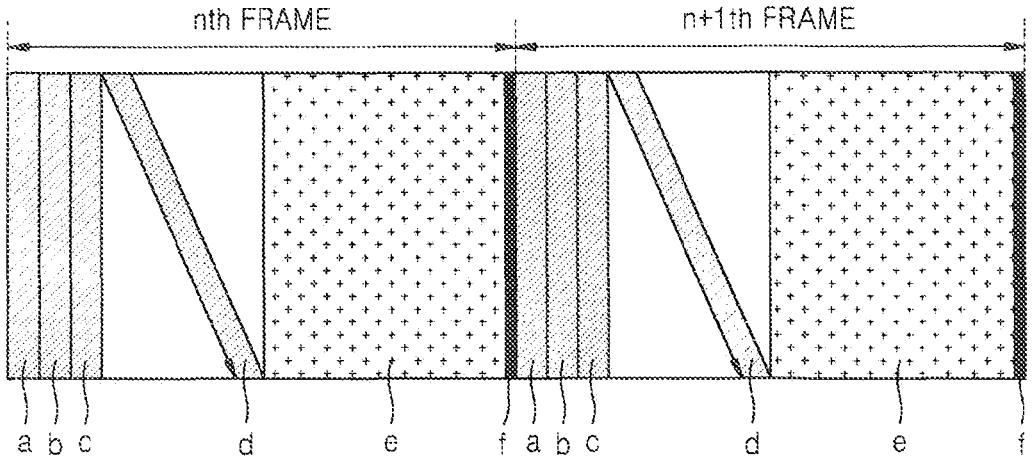
Figure 10:
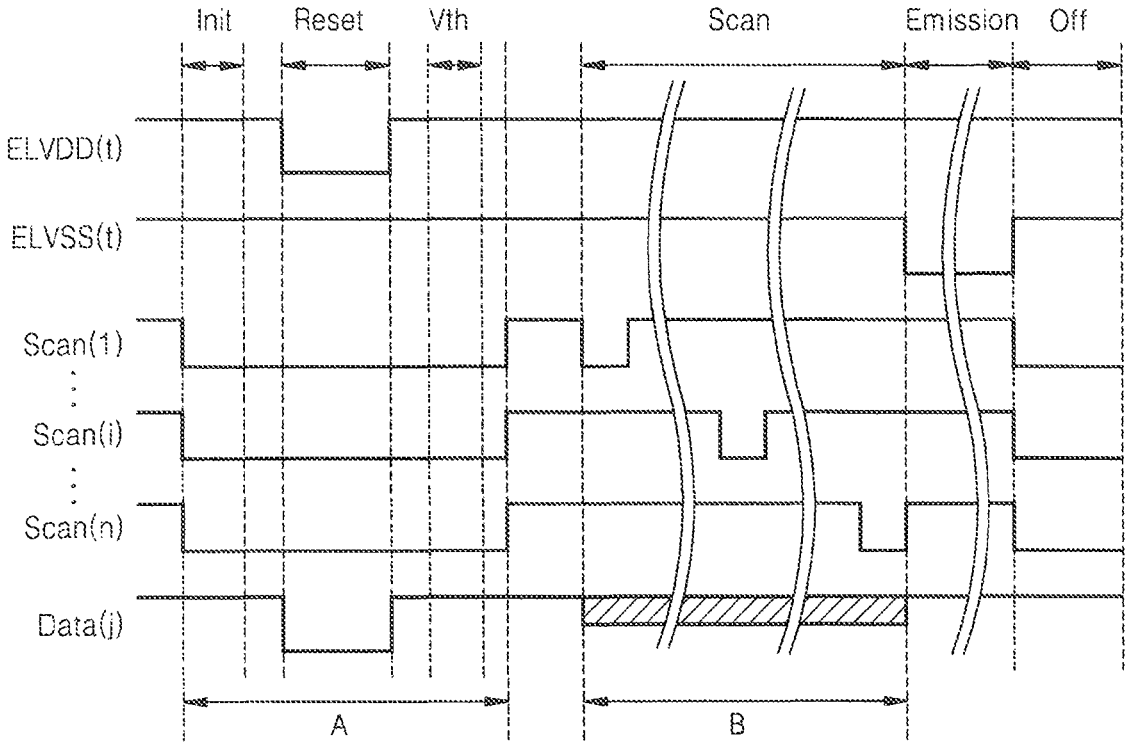
FIG. 10 is a pixel driving-timing diagram, according to an embodiment of the present invention.

FIGS. 7 through 9 illustrate a method of driving an organic light emitting display device, according to an embodiment of the present invention. FIG. 10 is a pixel driving-timing diagram, according to an embodiment of the present invention.

The present embodiment may be applied to a method of driving a first simultaneous emission-type organic light emitting display device. In a first simultaneous emission method, data is sequentially input during one frame period, and after the data input is completed, a total of the pixel unit 130, i.e., the pixels 140 in the pixel unit 130 simultaneously emit light.

In more detail, referring to FIG. 9, the driving method according to the present embodiment includes (a) initialization operation, (b) reset operation, (c) threshold voltage compensation operation, (d) scan operation (data input operation), (e) emission operation, and (f) emission off operation. The (d) scan operation (the data input operation) is performed in an order of scan lines, but the rest of operations, i.e., (a)

initialization operation, (b) reset operation, (c) threshold voltage compensation operation, (e) emission operation, and (f) emission off operation are simultaneously performed in the pixel unit 130.

Here, (a) initialization operation indicates a period in which a node voltage of a pixel circuit included in each pixel 140 is initialized to be the same as a voltage when a threshold voltage of a driving transistor is input, and (b) reset operation indicates a period in which a data voltage applied to each pixel 140 of the pixel unit 130 is reset, and a voltage of an anode of the OLED is dropped to be equal to or less than a voltage of a cathode so as to prevent emission of the OLED.

Also, (c) threshold voltage compensation operation indicates a period in which the threshold voltage of the driving transistor included in each pixel 140 is compensated, and (f) emission off operation indicates a period in which, after emission by each pixel 140, the emission is turned off for black insertion or dimming.

Accordingly, signals that are applied to (a) initialization operation, (b) reset operation, (c) threshold voltage compensation operation, (e) emission operation, and (f) emission off operation, i.e., a scan signal that is applied to each of the scan lines S1 through Sn, a first power ELVDD(t) and/or a second power ELVSS(t), which is applied to each pixel 140, and a control signal that is applied to each of the control lines GC1 through GCn are simultaneously applied to the pixels 140 of the pixel unit 130 by predetermined voltage levels, respectively.

In the first simultaneous emission method according to the present embodiment, (a) through (f) operations are temporally and clearly classified, thus, the number of transistors of compensation circuits, and the number of signal lines for controlling them included in each pixel 140 may be decreased, and a shutter-glass type three-dimensional (3D) display may be easily embodied.

In the shutter-glass type 3D display, when a user watches a screen while the user wears a shutter glass in which transmittances of a left eye/a right eye are switched between 0% and 100%, the screen that is displayed via an image display device, i.e., the pixel unit 130 of the organic light emitting display device 100, alternately outputs a left-eye image and a right-eye image for each of frames. Then, the user may watch the left-eye image and the right-eye image via a left eye and a right eye, respectively, and by doing so, a stereoscopic effect is realized.

Referring to FIG. 10, the pixels 140 are driven by the simultaneous emission method, and each frame is divided into an initialization period Init, a reset period Reset, a threshold voltage compensation period Vth, a scan/data input period Scan, an emission period Emission, and an emission off period Off.

Here, scan signals Scan(n) are sequentially input to scan lines in the scan/data input period Scan, and, in response to this sequential input, data signals are sequentially input to the pixels 140. However, in the rest of periods other than the scan/data input period Scan, signals, i.e., a first power ELVDD(t), a scan signal Scan(n), and a data signal Data(t), which have voltage levels that are pre-defined, are simultaneously applied to the pixels 140 in the pixel unit 130.

A threshold voltage compensation operation of a driving transistor in each pixel 140, and an emission operation by each pixel 140 are simultaneously performed by the pixels 140 in the pixel unit 130 according to frames.

In the first simultaneous emission method according to the present embodiment, the first scan driving unit 110 and the second scan driving unit 180 may operate in the test mode and the scan mode, respectively.

Referring to FIG. 7, the first scan driving unit 110 operates in a period B in which scan signals are sequentially applied to scan lines in the pixel driving-timing diagram of FIG. 9. A clock signal and a control signal are applied to the signal line SC of the first scan driving unit 110.

Accordingly, a first shift register block SR1 receives an initial scan start signal, the clock signal, and the control signal and then outputs a first scan signal Scan(1) to a first scan line S1. Afterward, a second shift register block SR2 receives the first scan signal Scan(1), the clock signal, and the control signal, and then outputs a second scan signal Scan(2) to a second scan line S2. Afterward, a third shift register block SR3 receives the second scan signal Scan(2), the clock signal, and the control signal, and then outputs a third scan signal Scan(3) to a third scan line S3. Similarly, fourth shift register block SR4 through $n_{th}$ shift register block SRn receive the third scan signal Scan(3) through a $(n-1)_{th}$ scan signal Scan (n−1) of previous stages, the clock signal, and the control signal, and then output scan signals Scan(4) through Scan(n) to scan lines S4 through Sn, respectively.

The scan signals Scan(1) through Scan(n) are sequentially applied to the scan lines S1 through Sn, and thus the pixels 140 that are connected to the scan lines S1 through Sn, respectively, are turned on, and then a data signal is applied to each of the pixels 140.

Referring to FIG. 8, the second scan driving unit 180 operates in a period A in which scan signals are simultaneously applied to all pixels in the pixel driving-timing diagram of FIG. 9. A first control signal is applied to the first control line 181 of the second scan driving unit 180, and a second control signal is applied to the second control line 185.

Accordingly, switching devices TR that are connected in parallel are all turned on by the first control signal, and the second control signal, as scan signals Scan(1) through Scan (n), is simultaneously applied to the scan lines S1 through Sn via the switching devices TR, respectively.

Figure 11:
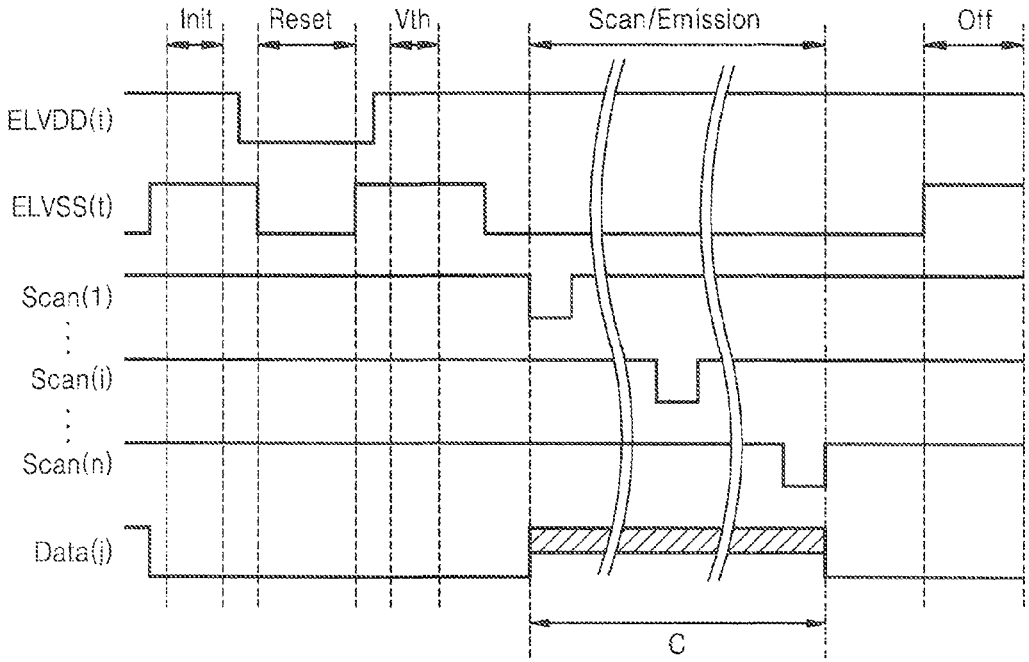
FIG. 11 is a pixel driving-timing diagram, according to another embodiment of the present invention.

FIG. 11 is a pixel driving-timing diagram, according to another embodiment of the present invention.

The present embodiment may be applied to a method of driving a second simultaneous emission-type organic light emitting display device. Compared to the first simultaneous emission method described with reference to FIGS. 9 and 10, the second simultaneous emission method according to the present embodiment is different in that, while a total of the pixel unit 130, i.e., the pixels 140 in the pixel unit 130 simultaneously emit light during one frame period, subsequent data signals are sequentially input.

Thus, the second scan driving unit 180 may operate only in the test mode, and the first scan driving unit 110 may operate in the test mode and the scan mode.

Referring to FIG. 11, the pixels 140 simultaneously emit light, and each frame is divided into an initialization period Init, a reset period Reset, a threshold voltage compensation period Vth, a scan and emission period Scan/Emission, and an emission off period Off.

Here, in the scan and emission period Scan/Emission, while the pixels 140 in the pixel unit 130 simultaneously emit light by a data signal that is previously input, scan signals Scan(n) are sequentially input to scan lines, and in response to this sequential input, the subsequent data signals are sequentially input to the pixels 140.

A threshold voltage compensation operation of a driving transistor in each pixel 140, and an emission operation by each pixel 140 are simultaneously performed by the pixels 140 in the pixel unit 130 according to frames. Compared to the first simultaneous emission method described with reference to FIG. 10, the second simultaneous emission method according to the present embodiment is advantageous in an improvement of a lifetime of an emitting device, a decrease in a driving voltage, an improvement of mura, a great emission duty ratio, or the like.

Referring to FIG. 7, the first scan driving unit 110 operates in a period B in which scan signals are sequentially applied to scan lines as soon as emission occurs in the pixel driving-timing diagram of FIG. 11. A clock signal and a control signal are applied to the signal line SC of the first scan driving unit 110.

Accordingly, a first shift register block SR1 receives an initial scan start signal, the clock signal, and the control signal and then outputs a first scan signal Scan(1) to a first scan line S1. Afterward, a second shift register block SR2 receives the first scan signal Scan(1), the clock signal, and the control signal, and then outputs a second scan signal Scan(2) to a second scan line S2. Afterward, a third shift register block SR3 receives the second scan signal Scan(2), the clock signal, and the control signal, and then outputs a third scan signal Scan(3) to a third scan line S3. Similarly, fourth shift register block SR4 through $n_{th}$ shift register block SRn receive the third scan signal Scan(3) through a $(n-1)_{th}$ scan signal Scan (n−1) of previous stages, the clock signal, and the control signal, and then output scan signals Scan(4) through Scan(n) to scan lines S4 through Sn, respectively.

The scan signals Scan(1) through Scan(n) are sequentially applied to the scan lines S1 through Sn, and thus the pixels 140 that are connected to the scan lines S1 through Sn, respectively, are turned on, and then a data signal is applied to each of the pixels 140.

In the one or more embodiments, a simple driving circuit capable of simultaneously applying scan signals or test signals to a scan, driving unit including shift register blocks is added, so that a defect test with respect to the pixel unit, and simultaneous emission by the pixel unit are possible.

The one or more embodiments are described with reference to the simultaneous emission-type organic light emitting display device. However, the one or more embodiments may be applied to an organic light emitting display device without a period A in which a scan signal is simultaneously applied to all pixels, or a progressive emission-type organic light emitting display device in which data signals are sequentially input to scan lines and then emission is performed in an order of the scan lines. In this case, the second scan driving unit 180 may operate only in the test mode, and the first scan driving unit 110 may operate in the test mode and the scan mode.

In the one or more embodiments, by adding a simple circuit, a defect of a panel and a driving circuit may be detected, and driving by simultaneous emission in the panel may be possible.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An organic light emitting display device comprising:

a pixel unit comprising a plurality of pixels formed in regions where a plurality of scan lines and a plurality of data lines cross each other, the plurality of pixels simultaneously emit light corresponding to data signals previously inputted in an emission period during which next data signals are inputted;

a first scan driving unit sequentially applying scan signals to the plurality of scan lines during the emission period for allowing the next data signals to be inputted to all of the plurality of pixels which are simultaneously emitting light corresponding to the data signals previously inputted in a normal mode; and a second scan driving unit detecting a defect from among all of the plurality of pixels by simultaneously applying a first test signal to the plurality of scan lines to simultaneously turn on the plurality of pixels to emit light, the second scan driving unit without a shift register.

2. The organic light emitting display device of claim 1, wherein the first scan driving unit has a plurality of stages, and each of the plurality of stages comprises a shift register.

3. The organic light emitting display device of claim 1, wherein the second scan driving unit comprises:

a first control line outputting a first control signal;

a second control line outputting a second control signal; and a plurality of switching devices each having a structure in which a gate is electrically connected to the first control line, a first electrode is electrically connected to the second control line, and a second electrode is electrically connected to a corresponding scan line from among the plurality of scan lines.

4. The organic light emitting display device of claim 3, wherein each of the plurality of switching devices is turned on by the first control signal and then outputs the second control signal, as the first test signal, to the corresponding scan line from among the plurality of scan lines.

5. The organic light emitting display device of claim 3, wherein the plurality of switching devices correspond to the plurality of scan lines, respectively, and are connected in parallel along the first control line and the second control line.

6. The organic light emitting display device of claim 3, wherein the second scan driving unit further comprises pads that apply the first control signal and the second control signal.

7. The organic light emitting display device of claim 2, wherein, in a test mode, the first scan driving unit detects a defect of the plurality of pixels by sequentially applying a second test signal to the plurality of scan lines according to whether the plurality of pixels emit light, and detects a defect of the plurality of stages according to whether the second test signal is outputted to the plurality of scan lines.

8. The organic light emitting display device of claim 1, further comprising:

a data driving unit applying a data signal to a pixel via a corresponding data line from among the plurality of data lines, the pixel is turned on by the first test signal or the second test signal; and a timing control unit controlling the first scan driving unit, the second scan driving unit, and the data driving unit.

9. An organic light emitting display device driven in a normal mode and a test mode, and comprising;

a pixel unit comprising a plurality of pixels formed in regions where a plurality of scan lines and a plurality of data lines cross each other;

a first scan driving unit detecting a defect among all of the plurality of pixels by sequentially applying a first test signal to the plurality of scan lines in the test mode, and sequentially applying a scan signal to the plurality of scan lines so that a data signal is applied to a pixel via a corresponding data line from among the plurality of data lines in the normal mode, the pixel being turned on by the scan signal; and a second scan driving unit detecting a defect from among all of the plurality of pixels by simultaneously applying a second test signal to the plurality of scan lines in the test mode to simultaneously turn on the plurality of pixels to emit light, the second scan driving unit without a shift register.

10. The organic light emitting display device of claim 9, wherein the first scan driving unit has a plurality of stages, and each of the plurality of stages comprises a shift register.

11. The organic light emitting display device of claim 9, wherein the second scan driving unit comprises:

a first control line outputting a first control signal;

a second control line outputting a second control signal; and a plurality of switching devices having a structure in which a gate is electrically connected to the first control line, a first electrode is electrically connected to the second control line, and a second electrode is electrically connected to a corresponding scan line from among the plurality of scan lines.

12. The organic light emitting display device of claim 10, wherein the first scan driving unit detects a defect of the plurality of stages according to whether the first test signal is output to the plurality of scan lines.

13. The organic light emitting display device of claim 9, wherein, in the normal mode, the first scan driving unit sequentially applies the scan signal to the plurality of scan lines during a section of one frame period, and the second scan driving unit simultaneously applies a scan signal to the plurality of scan lines during other sections of the one frame period.

14. The organic light emitting display device of claim 9, in the normal mode, the first scan driving unit sequentially applies a scan signal to the plurality of scan lines during a section of one frame period while the pixel unit emits light.

* * * * *